US006318041B1

(12) United States Patent
Stanley

(10) Patent No.: US 6,318,041 B1
(45) Date of Patent: Nov. 20, 2001

(54) PANEL SYSTEM WITH MOISTURE REMOVAL

(75) Inventor: Elmer Gene Stanley, Fort Worth, TX (US)

(73) Assignee: Starfoam Manufacturing, Inc., Fort Worth, TX (US)

( * ) Notice: Subject to any disclaimer, the term of this patent is extended or adjusted under 35 U.S.C. 154(b) by 0 days.

(21) Appl. No.: 08/915,293

(22) Filed: Aug. 20, 1997

Related U.S. Application Data

(60) Provisional application No. 60/032,601, filed on Dec. 11, 1996.

(51) Int. Cl.[7] ..... E04B 1/70

(52) U.S. Cl. ..... 52/505; 52/302.4; 52/220.2; 52/220.3; 52/310

(58) Field of Search ..... 52/503, 505, 302.4, 52/302.1, 220.2, 607, 606, 169.5, 169.11, 309.7, 309.12, 310, 379, 220.3

(56) References Cited

U.S. PATENT DOCUMENTS

| | | | | |
|---|---|---|---|---|
| 738,643 | * | 9/1903 | Van Camp . | |
| 756,300 | * | 4/1904 | Underwood . | |
| 835,669 | * | 11/1906 | Eckley | 52/302.4 |
| 836,017 | * | 11/1906 | Douglass | 52/302.4 X |
| 839,510 | * | 12/1906 | Propper et al. | 52/607 |
| 861,348 | * | 7/1907 | Baltz | 52/505 |
| 1,521,922 | * | 1/1925 | Wilson et al. | 52/302.4 X |
| 1,524,146 | * | 1/1925 | Murray . | |
| 1,539,611 | * | 5/1925 | Trowbridge . | |
| 1,841,807 | * | 1/1932 | Harter . | |
| 2,701,959 | * | 2/1955 | Briggs | 52/505 |
| 3,000,144 | * | 9/1961 | Kitson | 52/309.12 X |
| 3,099,063 | * | 7/1963 | Santhany | 52/607 |
| 3,766,699 | * | 10/1973 | Dinkel . | |
| 3,965,686 | * | 6/1976 | Saito et al. | 61/11 |
| 4,207,718 | * | 6/1980 | Schaaf et al. . | |
| 4,719,738 | * | 1/1988 | Lee . | |
| 4,852,320 | * | 8/1989 | Ballantyne | 52/303 |
| 5,191,744 | * | 3/1993 | Bowes | 52/607 X |
| 5,241,795 | * | 9/1993 | Giroux et al. . | |
| 5,465,542 | * | 11/1995 | Terry | 52/309.12 X |
| 5,485,703 | * | 1/1996 | Nordahl | 52/607 X |
| 5,564,243 | * | 10/1996 | Kroll et al. . | |
| 5,566,521 | * | 10/1996 | Andrews et al. | 52/606 |
| 5,704,172 | * | 1/1998 | Gougeon et al. | 52/169.11 |
| 5,809,720 | * | 9/1998 | Sauve . | |

FOREIGN PATENT DOCUMENTS

| | | | | |
|---|---|---|---|---|
| 30162 | * | 1/1911 | (SE) | 52/607 |

* cited by examiner

*Primary Examiner*—Carl D. Friedman
*Assistant Examiner*—Phi Dieu Tran A
(74) *Attorney, Agent, or Firm*—Christopher L. Makay

(57) ABSTRACT

An insulation panel includes a first surface, a second surface opposite the first surface, a first side, a second side, a third side opposite the first side, and a fourth side opposite the second side. The first, second, third, and fourth sides define a perimeter of the panel. The insulation panel also includes a first conduit and a second conduit internal with respect to the first and second surfaces and extending between the first and third sides. The insulation panel further includes a third conduit and a fourth conduit internal with respect to the first and second surfaces and extending between the second and fourth sides. The conduits remove moisture that accumulates underneath the panel. Moreover, the insulation panel includes a slit extending from the perimeter to the first, second, third, and fourth conduits for discharging water accumulated within the insulation panel.

39 Claims, 3 Drawing Sheets

PANEL SYSTEM WITH MOISTURE REMOVAL

This application claims the benefit of U.S. Provisional Application No. 60/032,601, filed Dec. 11, 1996.

BACKGROUND OF THE INVENTION

1. Field of the Invention

The present invention relates to insulation panels, and more particularly, but not by way of limitation, to an insulation panel having a moisture removal system.

2. Description of the Related Art

One building construction system utilizing rigid insulation panels attached to the exterior of the building's walls is known as Exterior Insulation Finish System (EIFS). In this type construction the insulation is mounted on the exterior of the building wall and a finish coat of some suitable material, such as stucco, is applied. One common type of exterior insulation panel is made from expanded polystyrene (EPS). Panels of EPS insulation are attached to a substrate, such as plywood, by using mechanical fasteners or mastic.

However, a problem arises when water, often around windows and doors, seeps into the panels. Although conventional rigid insulation absorbs one to three percent moisture by volume, EIFS panels retard moisture. If moisture leaks in, it becomes trapped for a prolonged period within the cellular structure of the panel. Accumulated water saturates the insulation panels and may bleed to the insulation's exterior and discolor it. Also, trapped water mildews or rots the underlying substrate, such as plywood or gypsum. In addition, although the water does not damage the insulation, water trapped for prolong periods does, however, degrade the mastic attaching the panel to the building. This degradation of the mastic results in the insulation detaching from the building. As a result, local permitting authorities require some mechanism to discharge accumulated water underneath the EIFS panels.

One attempt at a solution is shown in FIG. 1, which utilizes vertical angular-cut grooves on the insulation panel surface. This surface is attached to the building substrate. These grooves form a channel adjacent to the substrate for directing water down to the ground for discharge, thereby eliminating the build-up of water within the panel.

This solution suffers several disadvantages. The grooves reduce the bonding surface between the insulation panel and the building, which may result in inadequately attached panels. In addition, the grooves extend into the insulation panel, thereby impairing the structural integrity of the panel, especially when the panels are less than two inches thick. Furthermore, mastic applied to the panel may block the grooves, thereby preventing grooves from forming open channels for the escape of water between the insulation panel and building.

Accordingly, an insulation panel that permits the removal of trapped water and provides increased bonding surface between the insulation panel and the building, improved structural integrity of the panels, and substantially unimpaired water conduits will improve over conventional insulation panels.

SUMMARY OF THE INVENTION

In accordance with the present invention, an insulation panel includes a first surface, a second surface opposite the first surface, a first side, a second side, a third side opposite the first side, and a fourth side opposite the second side. The first, second, third, and fourth sides define a perimeter of the panel. The insulation panel also includes a first conduit and a second conduit internal with respect to the first and second surfaces and extending between the first and third sides. The insulation panel further includes a third conduit and a fourth conduit internal with respect to the first and second surfaces and extending between the second and fourth sides. The conduits remove moisture that accumulates underneath the panel. The insulation panel includes a slit extending from the perimeter to the first, second, third, and fourth conduits for discharging water accumulated within the insulation panel.

It is, therefore, an object of the present invention to provide an insulation panel with improved structural integrity.

Another object of the present invention is to provide an insulation panel with increased bonding surface area.

A further object of the present invention is to provide an insulation panel with internal water conduits that are not blocked by mastic when attaching the panel to the building.

Still other objects, features, and advantages of the present invention will become evident to those skilled in the art in light of the following.

DETAILED DESCRIPTION OF THE PREFERRED EMBODIMENT

Figure 1:
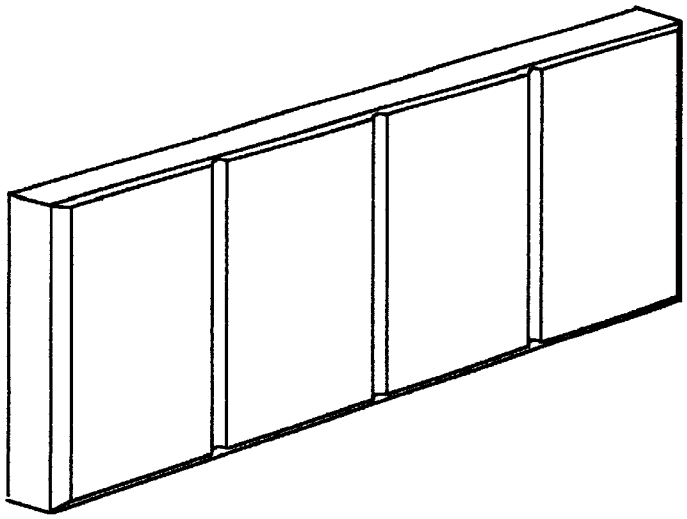
FIG. 1 (PRIOR ART)
FIG. 1 is a perspective view of a prior art insulation panel.
Figure 2:
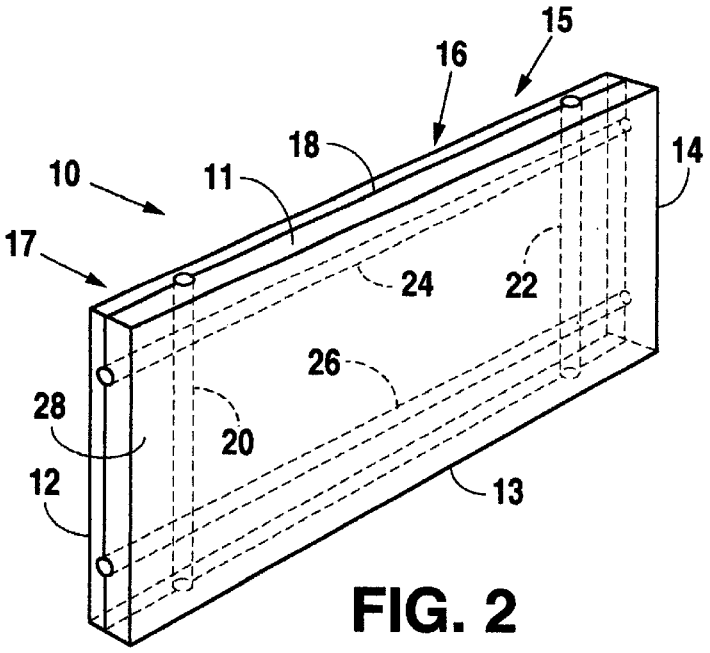
FIG. 2 is a perspective view of a first embodiment of an insulation panel.
Figure 3:
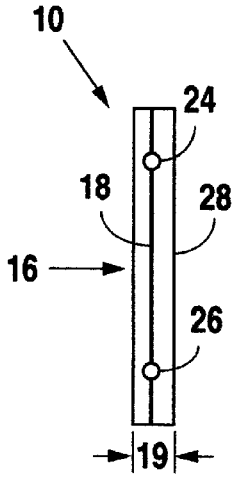
FIG. 3 is a side, elevational view of the first embodiment of the insulation panel.

As illustrated in FIGS. 2–4 and 6–7, a first embodiment of an insulation panel 10, preferably constructed from EPS, includes a first side 11, a second side 12, a third side 13, a fourth side 14, a first or facing surface 16, and a second or exterior surface 28. The panel 10 has a physical structure that contains voids permitting the migration of water therethrough.

The panel 10 also has an internal conduit system 15 for removing water. The internal conduit system 15 includes a first conduit 20, a second conduit 22, a third conduit 24, and a fourth conduit 26. Preferably first and second conduits 20 and 22 are substantially vertical and third and fourth conduits 24 and 26 are substantially horizontal. Although in this first embodiment four conduits 20, 22, 24 and 26 form a grid-like pattern, one of ordinary skill will readily recognize that other patterns and/or numbers of internal conduits may be used. Preferably, conduits 20, 22, 24, and 26 are substantially circular in shape having diameters of approximately 0.25 inch to 0.375 inch. However, other shaped conduits, such as rectangular or triangular, may be utilized. Typically, the panel 10 has a thickness 19 of 1 to 4 inches. Conduits 20, 22, 24, and 26 are positioned within 0.125 to 0.25 inch from the surface 16 facing the building.

The panel 10 also includes a slit 18, typically having a width 21 of 0.047 inch, running around its perimeter 17 created by a hot wire cutting device when creating the conduits 20, 22, 24 and 26. The slit 18 extends from the perimeter 17 of the panel 10 to the conduits 20, 22, 24 and 26.

When attaching the panel 10 to a substrate, typically mastic is applied to the facing surface 16. Due to their location, neither the slit 18 nor the conduits 20, 22, 24 and 26 come into contact with the mastic, thereby preventing the conduits 20, 22, 24 and 26 from being blocked with mastic.

Figure 4:
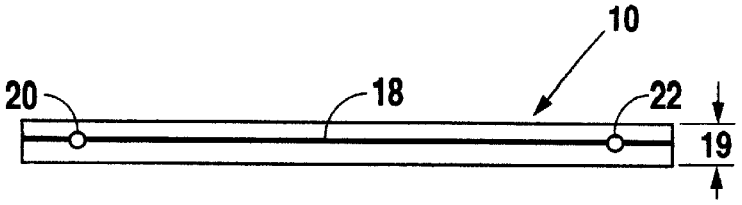
FIG. 4 is a top, plan view of the first embodiment of the insulation panel.
Figure 5:
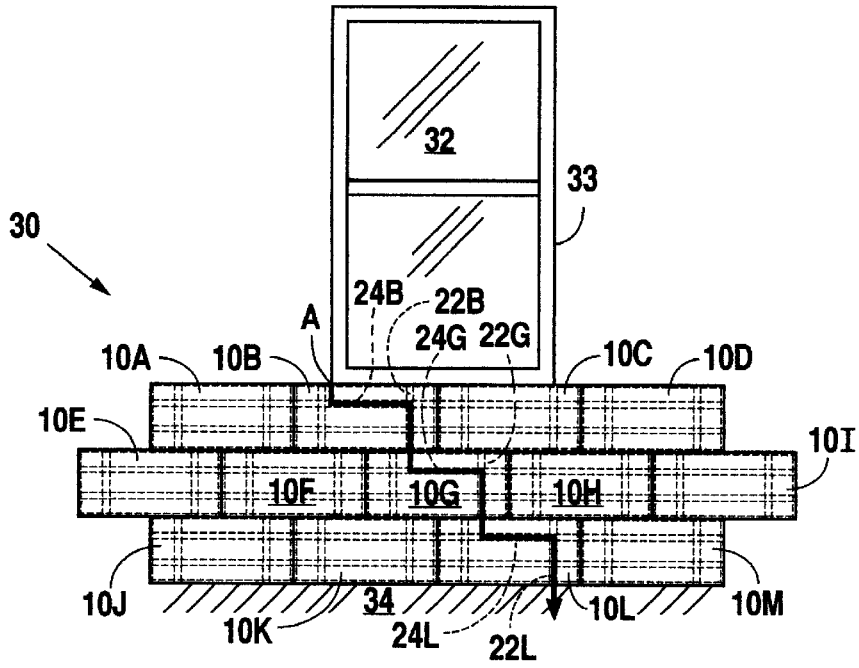
FIG. 5 is a front, elevational view of a building having a first embodiment of the water removal system attached to its outer surface.
Figure 6:
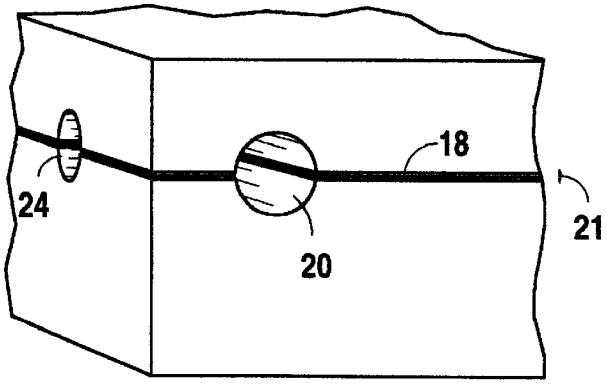
FIG. 6 is a perspective, close-up view of one corner of the first embodiment of the insulation panel.
Figure 7:
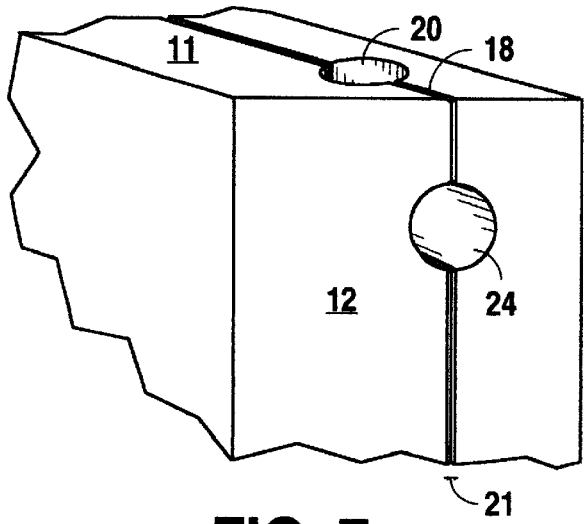
FIG. 7 is a perspective, close-up view of another corner of the first embodiment of the insulation panel.

As illustrated in FIG. 4, a panel system 30 includes staggered rows of insulation panels 10A–M. Preferably, each panel 10A–M is attached so that their slits 18A–M abut and align with another panel's slits 18A–M. The panel system 30 removes water seeping in around a window 32, or water that has penetrated and built-up within the panels 10A–M. The panel system 30 is designed to route water to vertical conduits for expedited discharge to the ground. The following example illustrates one way the system 30 discharges water accumulated underneath the panels 10A–M.

For this example, water is assumed to seep in and accumulate underneath the panel 10B at point A of a frame 33 of the window 32. In addition, the ground 34 slopes so that a panel 10A elevated slightly higher than a panel 10D. Initially, accumulated water at A travels downward through a panel 10B, via a slit 18B or through voids in the panel 10B, to a substantially horizontal conduit 24B. Next, due to the slope of the ground, the water travels along the substantially horizontal conduit 24B and into a substantially vertical conduit 22B. Water flows relatively rapidly downward through the substantially vertical conduit 22B until it reaches a panel 10G. Water then travels downward through the panel 10G, via a slit 18G or through voids in the panel 10G, until it reaches a substantially horizontal conduit 24G. Next, due to the slope of the ground, the water travels along the substantially horizontal conduit 24G and into a substantially vertical conduit 22G. Water then flows relatively rapidly downward through the substantially vertical conduit 22G until it reaches a panel 10L. Water then travels downward through the panel 10L, via a slit 18L or through voids in the panel 10L, until it reaches a substantially horizontal conduit 24L. Next, due to the slope of the ground, the water travels along the substantially horizontal conduit 24L and into a substantially vertical conduit 22L. Subsequently, the water travels relatively rapidly downward through the conduit 22L to the ground 34. The system 30 quickly and effectively removes moisture between the panels 10A–M and the underlying substrate.

Figure 8:
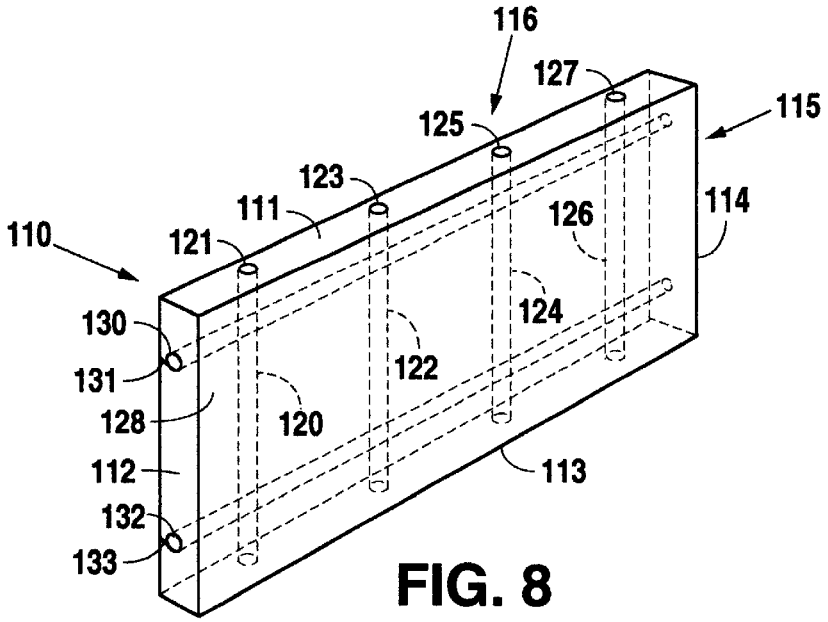
FIG. 8 is a perspective view of a second embodiment of an insulation panel.
Figure 9:
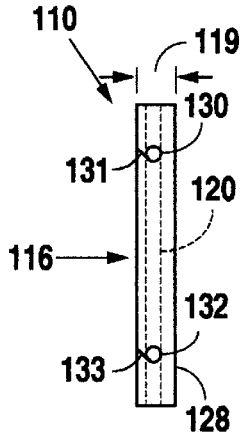
FIG. 9 is a side, elevational view of the second embodiment of the insulation panel.
Figure 10:
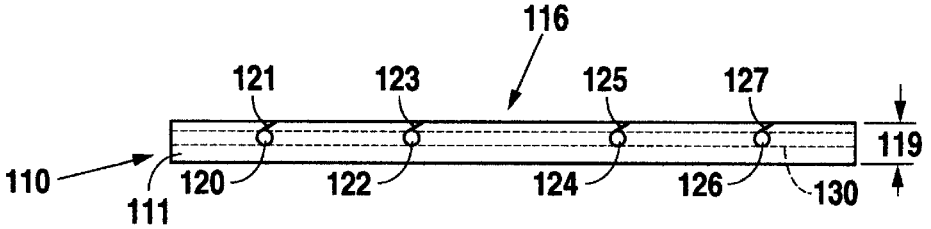
FIG. 10 is a top, plan view of the second embodiment of the insulation panel.

As illustrated in FIGS. 8–10, a second embodiment of a panel 110, preferably insulation constructed from EPS, includes a first side 111, a second side 112, a third side 113, a fourth side 114, a first or facing surface 116, and a second or exterior surface 128. The panel 110 has a physical structure that contains voids permitting the migration of water therethrough.

The panel 110 also has an internal conduit system 115 for removing water. The internal conduit system 115 includes a first conduit 120, a second conduit 122, a third conduit 130, a fourth conduit 132, a fifth conduit 124, and a sixth conduit 126. Preferably, the first, second, fifth and sixth conduits 120, 122, 124, and 126 are substantially vertical and the third and fourth conduits 130 and 132 are substantially horizontal. Although in this second embodiment six conduits 120, 122, 124, 126, 130 and 132 form a grid-like pattern, one of ordinary skill will readily recognize that other patterns and/or numbers of internal conduits may be used. Preferably, conduits 120, 122, 124, 126, 130 and 132 are substantially circular in shape having diameters of approximately 0.25 inch to 0.375 inch. However, other shaped conduits, such as rectangular or triangular, may also be utilized. Typically, the panel 110 has a thickness 119 of 1 to 4 inches. The conduits 120, 122, 124, 126, 130 and 132 are positioned within 0.125 to 0.25 inch from the surface 116 facing the building.

The panel 110 also includes slits 121, 123, 125, 127, 131, and 133, each typically having a width of 0.047 inch, created by the hot wire cutting device when creating conduits 120, 122, 124, 126, 130 and 132. Slits 121, 123, 125, 127, 131, and 133 extend from the facing surface 116 to respective conduits 120, 122, 124, 126, 130 and 132.

When attaching the panel 110 to a substrate, typically mastic is applied to the facing surface 116. But unique features of the slits 121, 123, 125, 127, 131, and 133 prevent mastic from reaching and plugging the conduits 120, 122, 124, 126, 130, and 132. The mastic easily plugs and seals the small openings of the slits 121, 123, 125, 127, 131, and 133 when attaching the panel 110 to a substrate. In addition, applying pressure to the panel 110 during attachment to the substrate closes the slits 121, 123, 125, 127, 131, and 133 due to their angled cut with respect to the facing surface 116. These features of the slits 121, 123, 125, 127, 131, and 133 prevent mastic from reaching and blocking conduits 120, 122, 124, 126, 130 and 132.

Figure 11:
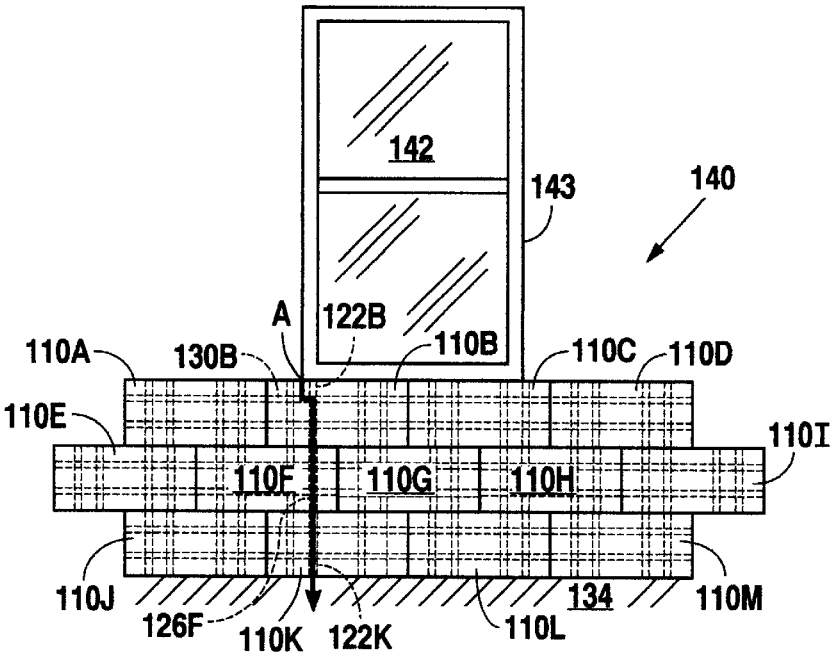
FIG. 11 is a front, elevational view of a building having a second embodiment of the water removal system attached to its outer surface.

As illustrated in FIG. 11, a panel system 140 includes staggered rows of insulation panels 110A–M. The panel system 140 removes water seeping in around a window 142, or water that has penetrated and built-up within the panels 110A–M. The panels 110A–M are attached to the substrate so that their vertical conduits are aligned. The panel system 140 is designed to quickly route water to vertical conduits for expedited discharge to the ground. The following example illustrates one way the system 140 discharges water accumulated underneath the panels 110A–M.

For this example, water is assumed to seep in and accumulate underneath the panel 110B at point A of a frame 143 of the window 142. In addition, the ground 134 slopes so that a panel 110A is elevated slightly higher than a panel 110D. Accumulated water at A initially travels downward through a panel 110B to a substantially horizontal conduit 130B within the panel 110B. Next, due to the slope of the ground, the water travels along the substantially horizontal conduit 130B and into a substantially vertical conduit 122B. Water flows relatively rapidly downward through the substantially vertical conduit 122B until it reaches a corresponding vertical conduit 126F in a panel 110F. Water then travels relatively rapidly downward through the conduit 126F until it reaches a corresponding vertical conduit 122K in a panel 110K. Subsequently, the water travels relatively rapidly downward through the conduit 122K to the ground 134. The system 140 quickly and effectively removes moisture between the panels 10A–M and underlying substrate.

Because water may travel through voids within the structure of the panel 110, a modified internal conduit system 115 could include only two substantially vertical conduits and two substantially horizontal conduits for each panel 110. When the panels 110 are arranged in staggered rows to form the panel system 140, the vertical conduits for each row are offset. Water accumulated at point A of the system 140 would flow similarly as previously described for the panel system 30.

Although the preferred embodiments utilized insulation panels constructed from EPS, the conduit systems 15 and 115 may be used in other types of external paneling besides insulation. Furthermore, although the preferred embodiments utilized substantially rectangular panels having a length of 48 inches and a width of 24 inches, other shapes, such as squares or triangles, or sizes of panels may also be utilized.

From the foregoing description and illustration of this invention it is apparent that various modifications may be made by reconfigurations or combinations producing similar results. It is, therefore, the desire of the applicant not to be bound by the description of this invention as contained in this specification, but be bound only by the claims as appended hereto.

I claim:

1. A panel system, comprising:

a body comprising:

a surface, a depth extending from the surface, and a first conduit extending through the body and located within the depth for channeling water through the body, wherein locating the first conduit within the depth increases the structural integrity of the body and the amount of the surface available for attachment; and a building wall receiving the body thereon, whereby the surface attaches to the building wall with no space therebetween.

2. The panel system according to claim 1 wherein the surface is adhesively secured to the building wall.

3. The panel system according to claim 1 wherein mastic is applied between the surface and the building wall, thereby facilitating attachment of the surface to the building wall.

4. The panel system according to claim 1 wherein the body further comprises a first slit extending along the depth for directing water to the first conduit.

5. The panel system according to claim 1 wherein the body further comprises a second slit extending from the surface along the depth to the first conduit for directing water thereto.

6. The panel system according to claim 5 wherein the second slit is adapted to direct water away from the building wall.

7. The panel system according to claim 5 wherein the second slit extends from the surface to the conduit at an angle.

8. The panel system according to claim 1 wherein the first conduit comprises a portion of a conduit array extending through the body along the depth, whereby water is channeled through the body.

9. The panel system according to claim 1 wherein the first conduit extends through the body in a substantially vertical direction.

10. The panel system according to claim 9 wherein the body further comprises a second conduit extending therethrough along the depth in a substantially horizontal direction such that the first and second conduits fluidly communicate and are adapted to channel water through the body.

11. The panel system according to claim 10 further comprising a first slit in the body extending along the depth for directing water to the first and second conduits.

12. The panel system according to claim 11 wherein the body further comprises a second slit extending from the surface along the depth to the second conduit for directing water thereto.

13. The panel system according to claim 12 wherein the second slit is adapted to direct water away from the building.

14. The panel system according to claim 12 wherein the second slit extends from the surface to the second conduit at an angle.

15. A panel system, comprising:

a plurality of bodies, wherein each body comprises:

a surface, a depth extending from the surface, and a first conduit extending through the body and located within the depth for channeling water through the body, wherein locating the first conduit within the depth increases the structural integrity of the body and the amount of the surface available for attachment; and a building wall receiving the plurality of bodies thereon, whereby the surface of each body attaches to the building wall with no space therebetween and the plurality of bodies are positioned such that a first conduit from one body aligns and fluidly communicates with a first conduit from an adjoining body, thereby channeling water from the plurality of bodies.

16. The panel system according to claim 15 wherein the surface of each body is adhesively secured to the building wall.

17. The panel system according to claim 15 wherein mastic is applied between the surface of each body and the building wall, thereby facilitating attachment of the surface of each body to the building wall.

18. The panel system according to claim 15 wherein each body further comprises a first slit extending along the depth for directing water to the first conduit.

19. The panel system according to claim 15 wherein each body further comprises a second slit extending from the surface of each body along the depth to the first conduit for directing water thereto.

20. The panel system according to claim 19 wherein the second slit of each body directs water away from the building wall.

21. The panel system according to claim 19 wherein the second slit extends from the surface to the conduit at an angle.

22. The panel system according to claim 15 wherein the first conduit of each body comprises a portion of a conduit array extending through each body along the depth, whereby, when the plurality of bodies are positioned in a plurality of rows, a conduit array from one body aligns and fluidly communicates with a conduit array from an adjoining body, thereby channeling water from the plurality of bodies.

23. The panel system according to claim 15 wherein the first conduit of each body extends therethrough in a substantially vertical direction.

24. The panel system according to claim 23 wherein each body further comprises a second conduit extending therethrough in a substantially horizontal direction such that the first and second conduits of each body fluidly communicate, whereby, when the plurality of bodies are positioned, a second conduit from one body aligns and fluidly communicates with a second conduit from an adjoining body, thereby channeling water from the plurality of bodies.

25. The panel system according to claim 24 wherein each body further comprises a first slit extending along the depth for directing water to the first and second conduits.

26. The panel system according to claim 25 wherein each body further comprises a second slit extending from the surface along the depth to the second conduit for directing water thereto.

27. The panel system according to claim 26 wherein the second slit is adapted to direct water away from the building.

28. The panel system according to claim 26 wherein the second slit extends from each surface to the second conduit at an angle.

29. A method of attaching a panel system to a building wall, comprising the steps of:

providing a plurality of bodies, wherein each body comprises:

a surface, a depth extending from the surface, and a first conduit extending through the body and located within the depth for channeling water through the body, wherein locating the first conduit within the depth increases the structural integrity of the body and the amount of the surface available for attachment;

providing a building wall that receives the plurality of bodies thereon;

attaching the surface of each body to the building wall with no space therebetween, whereby the plurality of bodies are positioned such that a first conduit from one body aligns and fluidly communicates with a first conduit from an adjoining body; and channeling water from the plurality of bodies using the first conduit of each body.

30. The method according to claim 29 wherein the step of attaching includes adhesively securing the surface of each body to the building wall.

31. The method according to claim 29 wherein the step of attaching includes applying mastic between the surface of each body and the building wall, thereby facilitating attachment of the surface of each body to the building wall.

32. The method according to claim 29 further comprising the steps of:

providing a first slit extending along the depth of each body; and directing water to the first conduit of each body using the first slit of each body.

33. The method according to claim 29 further comprising the steps of:

providing a second slit extending from the surface of each body along the depth to the first conduit of each body; and directing water to the first conduit of each body using the second slit of each body.

34. The method according to claim 33 further comprising the step of directing water away from the building wall using the second slit of each body.

35. The method according to claim 29 wherein the step of providing further comprises extending the first conduit of each body therethrough in a substantially vertical direction.

36. The method according to claim 35 further comprising the steps of:

providing a second conduit extending through each body in a substantially horizontal direction such that the first and second conduits of each body fluidly communicate;

positioning the plurality of bodies such that a second conduit from one body aligns and fluidly communicates with a second conduit from an adjoining body; and channeling water from the plurality of bodies using the first and second conduits of each body.

37. The method according to claim 36 further comprising the steps of:

providing a first slit extending along the depth of each body; and directing water to the first and second conduits of each body using the first slit of each body.

38. The method according to claim 37 further comprising the steps of:

providing a second slit in each body extending from the surface along the depth to the second conduit; and directing water to the second conduit of each body using the second slit of each body.

39. The method according to claim 38 further comprising the step of directing water away from the building using the second slit of each body.

* * * * *